US007645051B2

(12) United States Patent
Schultz

(10) Patent No.: US 7,645,051 B2
(45) Date of Patent: Jan. 12, 2010

(54) LIGHTED CHAIR RAIL

(76) Inventor: James Trenton Schultz, 226 Linda La., Duncanville, TX (US) 75137

( * ) Notice: Subject to any disclaimer, the term of this patent is extended or adjusted under 35 U.S.C. 154(b) by 118 days.

(21) Appl. No.: 11/382,072

(22) Filed: May 8, 2006

(65) Prior Publication Data

US 2006/0256550 A1 Nov. 16, 2006

Related U.S. Application Data

(60) Provisional application No. 60/679,828, filed on May 11, 2005.

(51) Int. Cl.
*F21S 8/00* (2006.01)

(52) U.S. Cl. ..... 362/145; 362/150; 362/147; 362/152; 362/260; 362/382

(58) Field of Classification Search ..... 362/145, 362/260, 147, 150, 382
See application file for complete search history.

(56) References Cited

U.S. PATENT DOCUMENTS

| | | | | |
|---|---|---|---|---|
| 5,226,724 | A * | 7/1993 | Kanarek | 362/260 |
| 5,595,432 | A * | 1/1997 | Vanderhoof | 362/480 |
| 6,388,404 | B1 * | 5/2002 | Schnebly et al. | 318/16 |
| 6,717,049 | B1 * | 4/2004 | Makwinski | 174/481 |
| 7,267,461 | B2 * | 9/2007 | Kan et al. | 362/373 |
| 2009/0051779 | A1 * | 2/2009 | Rolston | 348/222.1 |

* cited by examiner

*Primary Examiner*—Sandra L O'Shea
*Assistant Examiner*—Jessica L McMillan

(57) ABSTRACT

A lighted chair rail comprises a frame secured to a wall and a horizontal facia mounted on the frame and positioned in a spaced apart relationship to the wall. Light bulbs supported on the frame direct light through a lens mounted on the horizontal facia onto the wall. The horizontal facia may also include decorative items.

1 Claim, 3 Drawing Sheets

LIGHTED CHAIR RAIL

CLAIM OF PRIORITY

Applicant claims priority based on provisional patent Ser. No. 60/679,828 filed May 11, 2005, the entire content of which is incorporated herein by reference.

TECHNICAL FIELD

This invention relates generally to chair rail moldings and indirect lighting, and more particularly to a lighted chair air rail for use in home and office lighting and decor.

BACKGROUND AND SUMMARY OF THE INVENTION

Chair rail moldings have traditionally been used to protect walls from being damaged by the backs of chairs, and more recently have been used as casings, bases, wallpaper borders, panel moldings, etc. Indirect lighting systems are used for various purposes such as providing lighting in addition to overhead and other traditional lighting systems, providing an alternative to traditional lighting systems, and various decorative purpose. Indirect lighting systems are useful in rooms where dim lighting levels are preferred at various times such as hallways during the night, a baby's nursery, and other areas where a low level of light is preferred over bright levels of traditional lighting. For example, indirect lighting is preferable in a baby's nursery during nighttime hours for periodically tending to the baby without disturbing the baby with bright lighting.

Heretofore indirect lighting has been available in various configurations and several alternatives exist for concealing indirect lighting at or near the top of walls, e.g., behind crown molding. However there is currently no chair rail molding configuration which provides means for mounting and concealing indirect lighting at or near the height of a chair rail.

The present invention comprises a chair rail design which overcomes foregoing and other difficulties which have long since characterized the prior art. In accordance with the broader aspects of the invention, there is provided means for supporting an indirect lighting system behind a decorative chair rail.

In accordance with more specific aspects of the invention, a horizontal facia mounts on a frame secured to a wall. The frame also comprises means for supporting an indirect lighting source. The horizontal facia may further comprise means for mounting decorative trim thereon. The resulting lighted chair rail provides an additional alternative light source which provides a low level light source when brighter lighting is undesirable.

The lighted chair rail of the present invention may also be configured to accommodate interchangeable decorate plates. Alternatively, the lighted chair rail may be configured to provide a lighted facing for an alternative decorative appearance.

BRIEF DESCRIPTION OF THE DRAWINGS

A more complete understanding of the present invention may be had by reference to the following Detailed Description when taken in connection with the accompanying Drawings, wherein.

DETAILED DESCRIPTION

Figure 1:
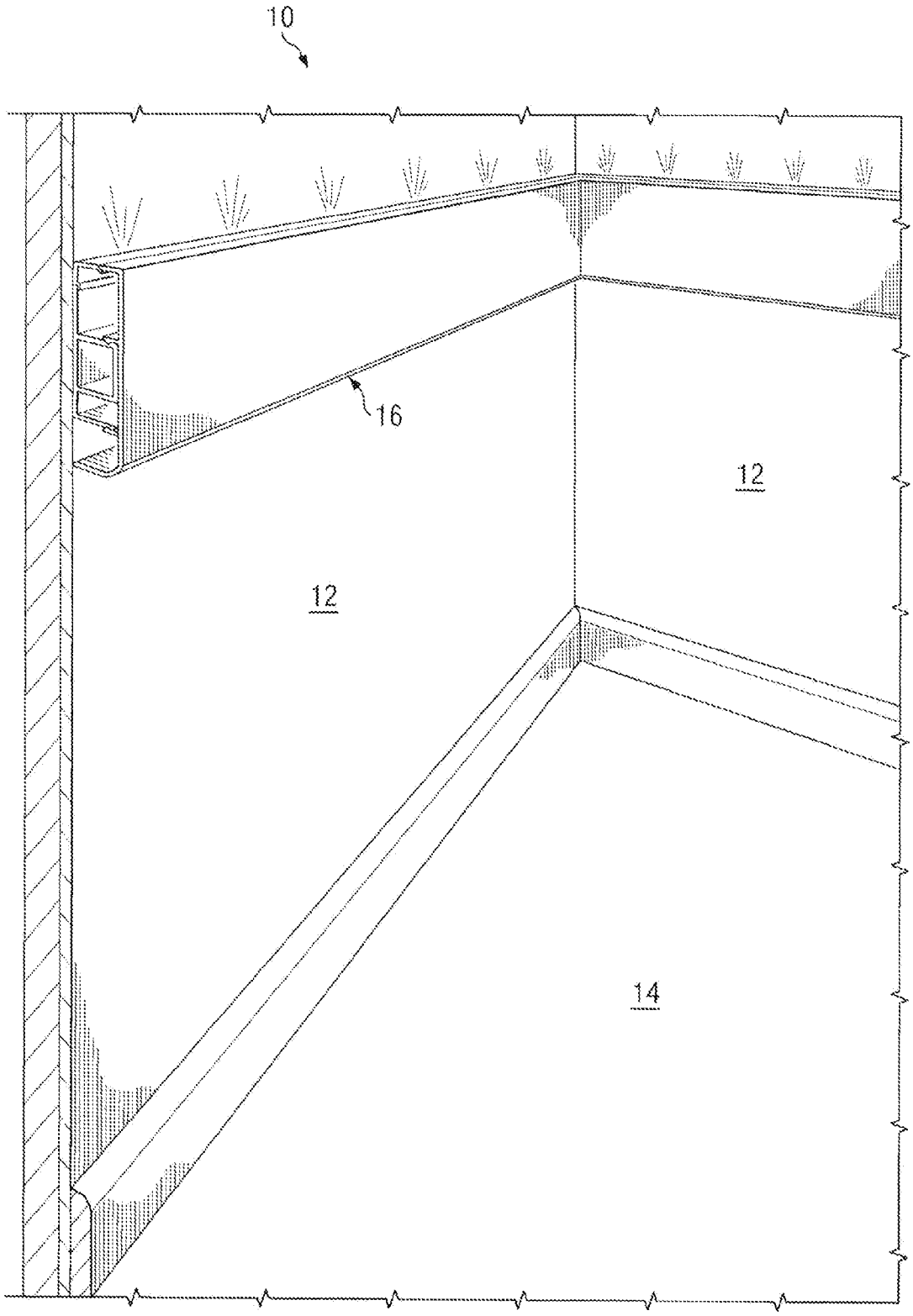
FIG. 1 is an environmental view illustrating a chair rail apparatus comprising a first embodiment of the present invention.

Referring now to the Drawings, and particularly to FIG. 1, there is shown a room 10 which may comprise an integral part of a home, an office, etc. The room 10 comprises a plurality of walls 12 and a floor 14, it being understood that the room 10 would typically also include a ceiling situated at the upper ends of the walls 12 and extending above the floor 14. In accordance with the present invention the walls 12 of the room 10 are provided with a lighted chair rail assembly 16. As will become more apparent hereinafter, the lighted chair rail assembly 16 may comprise any of the various embodiments of the invention illustrated in FIGS. 2-8, inclusive, and described hereinafter in conjunction herewith as well as variations thereof.

Figure 2:
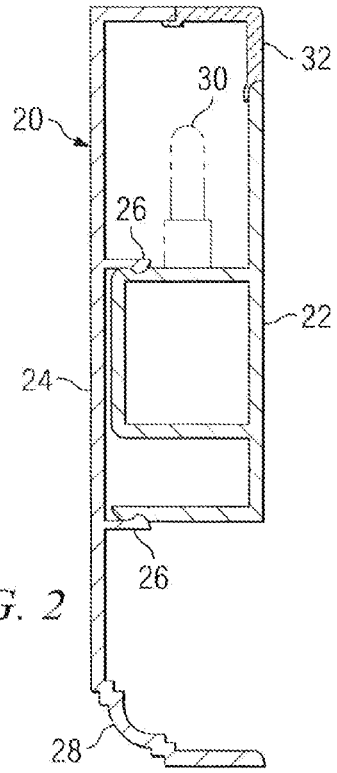
FIG. 2 is a sectional view of the chair rail apparatus of FIG. 1.

Referring to FIG. 2, there is shown a lighted chair rail 20 comprising the first embodiment of the present invention. The lighted chair rail 20 comprises a frame 22 which is secured to an interior wall within a home, an office, etc. by means of suitable fasteners and/or suitable adhesives. A facia 24 is detachably secured to the frame 22 by suitable fasteners 26 which are preferably integrally formed with the remaining components of the facia 24. The facia 22 may be provided with a decorative component 28 at the lower end thereof in the manner of typical chair rail constructions.

In addition to supporting the facia 24, the frame 22 supports a plurality of upright lighting assemblies 30. The lighting assemblies 30 are conventional in design and construction and are adapted for operation by typical household electrical current. Alternatively, the lighting assemblies 30 may be battery operated. A lens 32 is provided at the intersection between the frame 22 and the facia 24 whereby light generated by the lighting assemblies 30 is directed upwardly from the interior of the chair rail 20 in the manner illustrated in FIG. 1.

Figure 3:
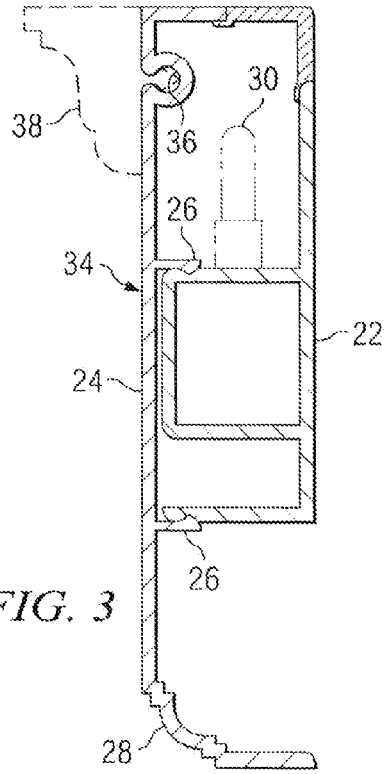
FIG. 3 is a sectional view of the chair rail apparatus of FIG. 1 comprising an additional component for mounting decorative trim thereon.

FIG. 3 illustrates a chair rail 34 comprising a variation of the chair rail 20 shown in FIG. 2 and described herein above in conjunction therewith. The chair rail 34 is substantially identical to the chair rail 20 but differs therefrom in that the facia 24 of the chair rail 34 is provided with an elongate groove 36 which detachably receives and supports a decorative accessory 38.

Figure 4:
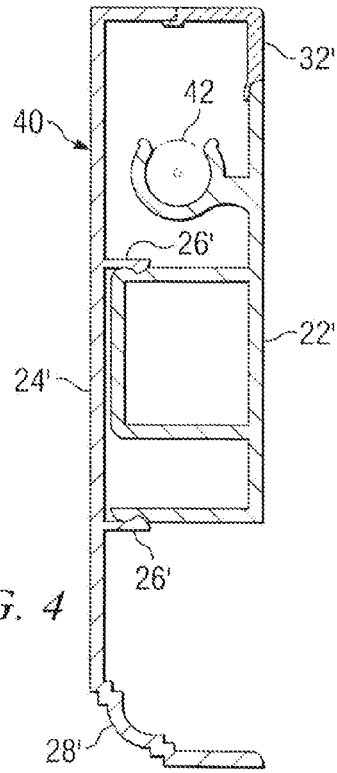
FIG. 4 is a sectional view similar to FIG. 2 illustrating a second embodiment of the invention.

FIG. 4 illustrates a chair rail 40 comprising a second embodiment of the invention. Many of the component parts of the chair rail 40 are substantially identical in construction and function to the component parts of the chair rail 20 as illustrated in FIG. 2 and described herein above in conjunction therewith. Such identical component parts are designated in FIG. 4 with the same reference numerals utilized in the foregoing description of the chair rail 20 but are differentially thereof by means of a prime (') designation. The chair rail 40 differs from the chair rail 20 in that rather than being provided with a plurality of upright lighting assemblies 30, the chair rail 40 is provided with a horizontally disposed lighting apparatus 42 which extends the entire length of the chair rail 40.

Figure 5:
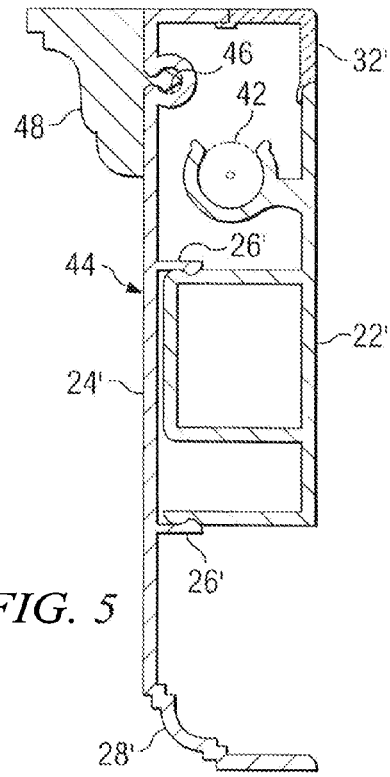
FIG. 5 is a sectional view similar to FIG. 3 further illustrating the second embodiment of the invention.

FIG. 5 illustrates a chair rail 44 comprising a variation of the chair rail 40 illustrated in FIG. 4 and described herein above in conjunction therewith. The chair rail 44 is identical to the chair rail 40 except that the facia 24' thereof is provided with a longitudinally extending groove 46 which supports a decorative assembly 48.

Figure 6:
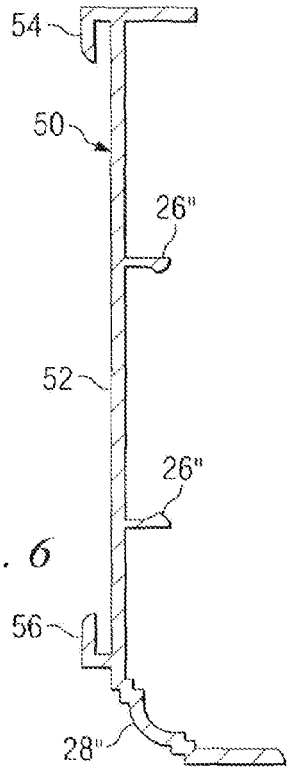
FIG. 6 is a sectional view illustrating a third embodiment of the invention.

Referring to FIG. 6, there is shown a chair rail component 50 comprising a third embodiment of the invention. The chair rail component 50 comprising a facia 52 which may be utilized in conjunction with the embodiments of the invention illustrated in FIGS. 2 and 3 in lieu of the facia 24 thereof, or in conjunction with the embodiments of the invention illustrated in FIGS. 4 and 5 in lieu of the facia 24' thereof. The facia 52 includes various components which are substantially identical to components of the facia 24 as shown in FIG. 2 and described herein above in conjunction therewith. Such identical components are designated in FIG. 6 with the same reference numerals utilized above in the description of the facia 24 but are differentiate therefrom by a double prime (") designation.

The facia 52 differs from the facia 24 of FIG. 2 in that the facia 52 is provided with opposed longitudinally extending flanges 54 and 56. The flanges 54 and 56 are utilized to receive and retain a decorative item which extends continuously along the entire length of the chair rail comprising the facia 52. Alternatively, the flanges 54 and 56 may support a plurality of decorative items located at spaced apart locations along the length of the chair rail comprising the facia 52.

Figure 7:
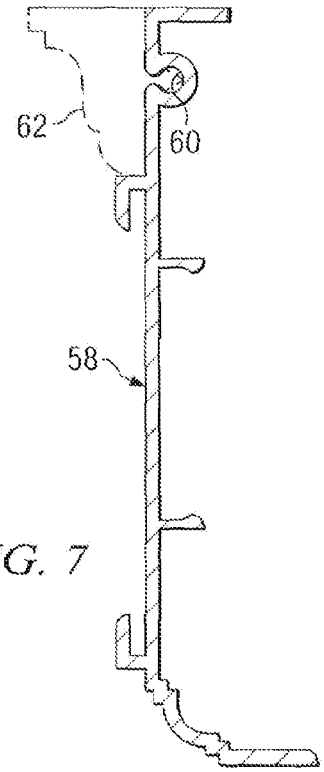
FIG. 7 is a sectional view similar to FIG. 6 illustrating an additional component for mounting decorative trim thereon.

FIG. 7 illustrates a chair rail 58 which is substantially identical in construction and function to the chair rail 50 illustrated in FIG. 6 and described herein above in conjunction therewith. The chair rail 58 differs from the chair rail 50 in that the chair rail 58 is provided with a longitudinally extending groove 60 which receives and supports a decorative accessory 62 extending longitudinally along the entire length of the chair rail comprising the facia 58.

Figure 8:
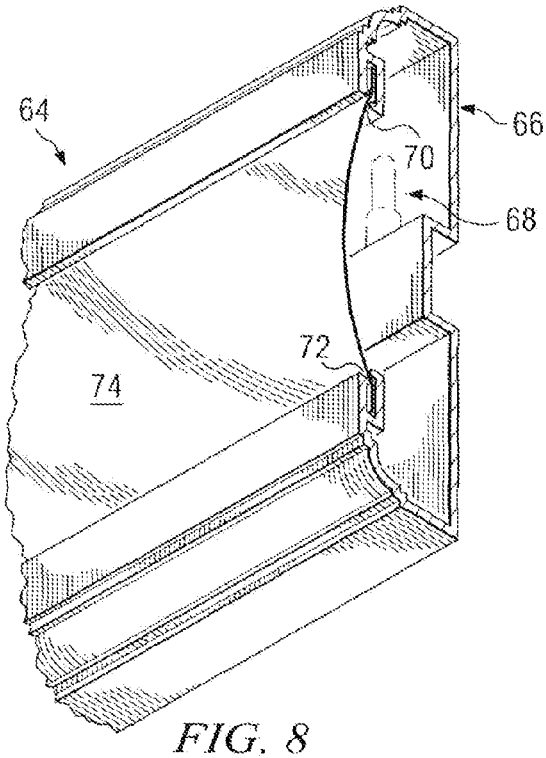
FIG. 8 is a perspective view illustrating a fourth embodiment of the invention in which certain components parts have been broken away more clearly to illustrate certain features of the invention.

Referring to FIG. 8, there is shown a lighted chair rail 64 comprising a fourth embodiment of the invention. The lighted chair rail 64 comprises a unitary frame 66 which extends the entire length of the chair rail 64. The frame 66 is supported on a wall and in turn supports one or more lighting assemblies 68 which may comprise either the vertically disposed lighting assemblies 30 shown in FIG. 2 and described herein above in conjunction therewith or the horizontally disposed lighting assemblies 42 shown in FIG. 4 and described herein above in conjunction therewith. The frame 66 is further characterized by a pair of opposed grooves 70 and 72.

The grooves 70 and 72 receive a facia 74. The facia 74 comprises a lens which allows light to pass outwardly from the lighting assemblies 68 into the room in which the chair rail 64 is deployed. The facia 74 is preferably translucent in nature such that light from the light assemblies 68 passes through the facia 74 but the lighting assemblies 68 are not directly observable therethrough.

Figure 9:
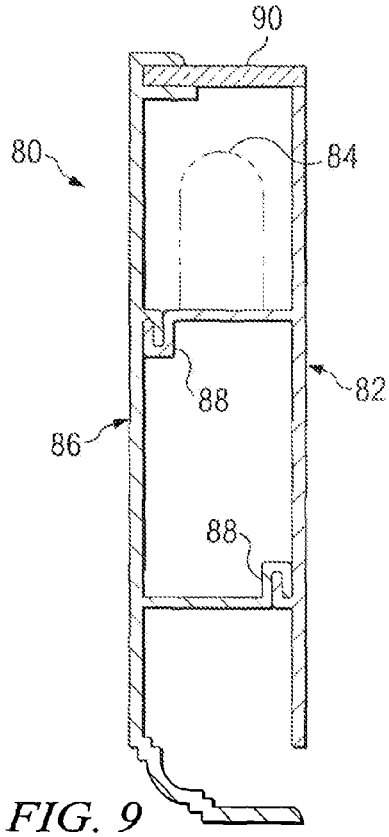
FIG. 9 is a sectional view illustrating a fifth embodiment of the invention.

Referring to FIG. 9, there is shown a lighted chair rail 80 comprising a fifth embodiment of the invention. The lighted chair rail 80 comprises a unitary frame 82 which extends the entire length of the chair rail 80 and which is normally supported on a wall. The frame 82 supports a plurality of light sources 84 preferably comprising silicon encased LED (light emitting diode) units. The lighted chair rail 80 further comprises a facia 86 which is secured on the frame 82 by a pair or tongue-and-groove connections 88. A white PLEXIGLAS® light diffuser lens 90 is supported on the facia 86 and on the upper end of the frame 82. The function of the lens 90 is to direct light from the light source 84 onto a wall having the frame 82 supported thereon.

Although preferred embodiments of the invention have been illustrated in the accompanying Drawings and described in the foregoing Detailed Description, it will be understood that the invention is not limited to the embodiments disclosed, but is capable of numerous rearrangements, modifications, and substitutions of parts and elements without departing from the spirit of the invention.

The invention claimed is:

1. An apparatus comprising:

a lighted chair rail frame including a rear wall;

a means for securing the frame to a wall with the rear wall of the frame extending adjacent and parallel to the wall;

a vertical facia; and a means for securing the vertical facia to the frame with the vertical facia positioned in a spaced apart relationship to the wall, the vertical facia extending to a substantially horizontal upper surface, the intersection between the rear wall of the frame, and the substantially horizontal surface of the vertical facia, wherein the vertical facia comprises a lens, a light source, and a means for supporting the light source on the frame with the light source positioned between the vertical facia and the wall, and wherein the lens comprises a means for directing the light from the light source onto the wall.

* * * * *